United States Patent [19]

Bronicki

[11] Patent Number: 4,622,472

[45] Date of Patent: Nov. 11, 1986

[54] HYBRID ELECTRIC POWER GENERATING SYSTEM

[75] Inventor: Lucien Y. Bronicki, Rehovot, Israel

[73] Assignee: Ormat Turbines Ltd., Yavne, Israel

[21] Appl. No.: 631,051

[22] Filed: Jul. 16, 1984

[51] Int. Cl.[4] ..... F01K 23/04

[52] U.S. Cl. ..... 290/52; 290/40 F; 60/655; 60/667

[58] Field of Search ..... 290/4 R, 40 R, 40 C, 290/40 F, 52; 60/695, 660, 664, 667, 706

[56] References Cited

U.S. PATENT DOCUMENTS

| | | | |
|---|---|---|---|
| 3,795,103 | 3/1974 | Anderson | 60/655 |
| 4,104,535 | 8/1978 | Bronicki | 290/52 |
| 4,117,344 | 9/1978 | Boerstler et al. | 290/52 |
| 4,444,015 | 4/1984 | Matsumoto et al. | 60/655 |
| 4,471,622 | 9/1984 | Kuwahara | 60/667 |

*Primary Examiner*—William M. Shoop, Jr.

*Assistant Examiner*—W. E. Duncanson, Jr.

*Attorney, Agent, or Firm*—Sandler & Greenblum

[57] ABSTRACT

A hybrid power system comprises a first energy converter operating on a closed Rankine cycle and including a vapor generator for vaporizing an organic working fluid in response to heat furnished from a heat source associated with a vapor generator, a turbo-generator responsive to vaporized working fluid for generating electrical power, and a condenser responsive to vapor exhausted from the turbo-generator for converting said vapor to a condensed liquid which is returned to the vapor generator. The system also includes a second energy converter including a thermo-electric generator having a junction, a heat source for heating said junction whereby said thermo-electric generator generates electrical power, and a heat pipe for conveying heat from said last mentioned heat source to the vapor generator of the first energy converter and to the junction.

17 Claims, 4 Drawing Figures

HYBRID ELECTRIC POWER GENERATING SYSTEM

TECHNICAL FIELD

This invention relates to an improved hybrid power generating system of the type described in U.S. Pat. No. 4,104,535, the disclosure of which is hereby incorporated by reference.

BACKGROUND ART

U.S. Pat. No. 4,104,535 discloses a hybrid electric power generating system having a pair of energy converters each operating on a closed Rankine cycle, each energy converter including a vapor generator for vaporizing a high molecular weight organic working fluid in response to heat furnished from a burner associated with the vapor generator. Each converter also includes a hermetically sealed turbo-generator responsive to varporized working fluid for generating electrical power, and a condenser responsive to exhaust vapors from the turbo-generator for converting such vapors to a condensed liquid which is returned to the vapor generator completing the working fluid cycle. A sensor, operatively associated with each converter senses the electrical output of the turbo-generator; and a control system, responsive to the sensors, controls the burners in the converters so that each converter furnishes about half the electrical load on the system in normal operation.

One of the converters operates with a working fluid having a higher boiling point than the working fluid in the other converter; and the condenser of the one converter rejects heat into the vapor generator of the other converter when the converters are in their normal mode of operation. With this arrangement, the fuel consumption of the entire system is about 60% of the fuel consumption of either of the converters when they individually operate to furnish 100% of the electrical load.

If, during the operation of the converters, a malfunction occurs in one, the sensor associated with that converter will produce a control signal to which the control of the system responds by shutting down the malfunctioning converter and increasing fuel supply to the other converter thus enabling the latter to furnish 100% of the load. The result is a highly-reliable hybrid electric power generating system which finds great application in remotely powered sites associated with pipelines or transmission line installations.

DESCRIPTION OF THE INVENTION

The present invention is concerned with improving the reliability by utilizing different energy sources and different modes for generating electrical power.

The improved hybrid power generating system according to the present invention includes a first energy converter operating on a closed Rankine cycle and including a vapor generator for vaporizing an organic working fluid in response to heat furnished from a heat source associated with the vapor generator, a turbo-generator responsive to vaporized working fluid for generating electrical power, a condenser responsive to vapor exhausted from the turbo-generator for converting said last mentioned vapor to a condensed liquid, and means for returning said liquid to the vapor generator. The system also includes a second energy converter including a thermo-electric generator having a junction, a heat source for heating said junction whereby said thermo-electric generator generates electrical power, and a heat pipe for conveying heat from the last mentioned heat source to the vapor generator of the first energy converter and to said junction.

According to this aspect of the invention, the thermoelectric generator provides an alternative source of electrical power as compared to the turbo-generator of the Rankine cycle converter. The thermocouple of the thermoelectric generator can be heated from a conventional fossil fuel fired source of the type used for providing heat to the Rankine cycle converter, or the heat source can be a nuclear reactor.

In another aspect of the present invention, a redundant power conversion system is provided comprising a plurality of energy converters of the type operating on a closed Rankine cycle utilizing an organic working fluid. Each converter has associated with it a heat source in the form of a burner, and a selectively operable fuel control valve for applying fuel to the burner which furnishes heat to the vapor generator. In addition, an operable nuclear reactor is provided for heating a vapor generator associated with the reactor and vaporizing an organic working fluid when the reactor is operational. A piping arrangement is provided for furnishing vaporized working fluid from the vapor generator associated with the reactor to each turbo-generator of the energy converters, and to the vapor generators of the converters in parallel. Control means are responsive to control signals generated by sensors associated with the turbo-generators of each of the converters for controlling operation of the nuclear reactor and the burners of the converters.

A nuclear reactor malfunction sensor is provided for producing a malfunction control signal in response to a malfunction of the nuclear reactor. The control means is operative, when the reactor is functioning normally, to effect the transfer of vaporized working fluid from the vapor generator associated with the nuclear reactor to each of the converters, and simultaneously, to prevent operation of the burners associated therewith. The control means is also responsive to a malfunction control signal, which is indicative of the reactor becoming, or remaining non-operational, for causing the burners associated with the converters to operate and furnish heat to the vapor generators of the respective converters.

The total rated output of the converters exceeds the normal maximum electrical load on the converters such that provision is made for overload conditions. The nuclear reactor is sized to provide sufficient heat for the simultaneous operation of all the converters at their rated outputs. If the reactor malfunctions and must be shut down, the burners associated with the converters are then made operational and the converters will still be able to furnish all the electrical load requirements. Finally, an auxiliary converter operating on fossil fuels may also be provided in parallel with the closed Rankine cycle organic working vapor converters for the purpose of providing power to the load when simultaneous maintenance is required on the organic Rankine cycle converters and the nuclear reactor. The result is a highly-reliable redundant electrical generating power supply system.

DESCRIPTION OF DRAWINGS

Embodiments of the present invention are disclosed in accompanying drawings wherein.

DETAILED DESCRIPTION

Figure 1:
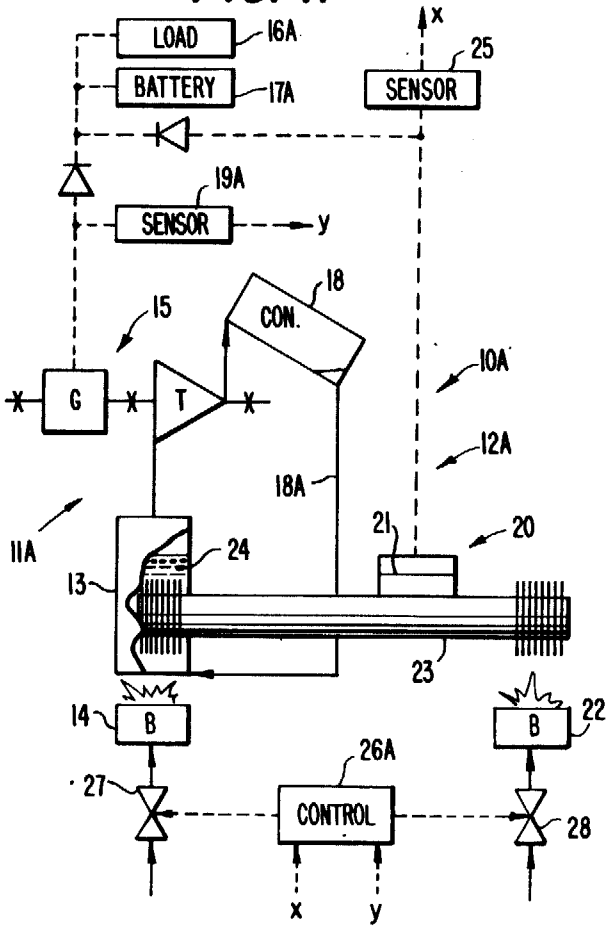
FIG. 1 is a block diagram of one embodiment of a hybrid electric power generating system according to the present invention utilizing one organic fluid Rankine cycle converter and a thermo-electric generator, each operating on conventional fossil fuels.
Figure 3:
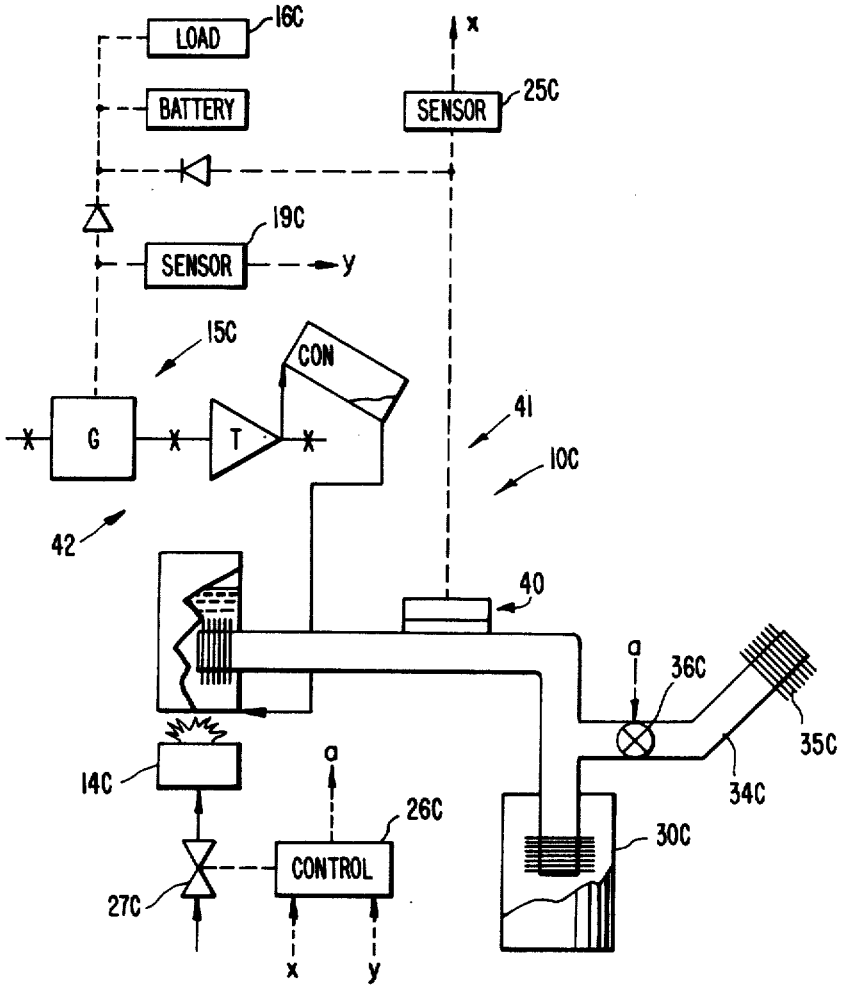
FIG. 3 is a block diagram of a further embodiment of the present invention wherein one of the converters is in the form of a thermo-electric generator, the heat therefore being supplied by a nuclear reactor.

Referring now to FIG. 1 of the drawing, reference 10A designates one embodiment of a hybrid electric power generating system according to the present invention. System 10A comprises two energy converters designated by reference 11A and 12A. Energy converter 11A is an organic fluid, closed Rankine cycle converter of the type disclosed in U.S. Pat. No. 4,104,535. This converter includes vapor generator 13 for vaporizing an organic working fluid in response to heat furnished from burner 14 operatively associated with the vapor generator.

Turbo-generator 15 is responsive to vaporized working fluid produced by vapor generator 13 for generating electric power which is supplied to load 16A. Battery backup 17A insures emergency back-up power for the load upon catastrophic failure. Finally, condenser 18 of converter 11A is responsive to vapor exhausted from turbo-generator 15 for converting the vapor to condensed liquid which is returned by conduit 18A to the vapor generator thus completing the organic working fluid cycle. Preferably, the elevation of the condenser with respect to the vapor generator is selected such that the hydrostatic head on the condensed liquid is adequate to permit it to enter the vapor generator.

Converter 11A also includes sensor 19A for generating a control signal designated "y" when the electric power generated by turbo-generator 15 decreases below a predetermined threshold. Thus, sensor 19A produces a control signal when the output of converter 11A begins to drop due to a malfunction in the converter, or in burner 14.

Converter 12A comprises thermo-electric generator 20, which is a conventional device that converts heat directly into electricity using the Seebeck effect. In such a device, two different conductors are joined in a loop, and by establishing a temperature differential across the junction 21 between the conductors, a generated voltage is produced. Conventional thermo-electric generators are available in sizes exceeding 5 KW with primary energy sources being hydrocarbon fuels, radioisotopes, as well as solar energy.

In the present invention, the heat source for converter 12A is burner 22 much like burner 14 in converter 11A. Converter 12A also includes heat pipe 23 by which heat produced by burner 22 is transferred both to junction 21 of the thermo-electric generator and to working fluid 24 contained in vapor generator 13 of converter 11A. Finally, sensor 25 associated with converter 12A monitors the electrical output of the thermoelectric generator and produces a control signal "x" when the output of the thermoelectric generator decreases below a predetermined threshold.

System 10A also includes control 26A which is capable of individually operating valves 27, 28 which control the fuel input to each of burners 14 and 22, respectively, in response to signals "x" and "y". Thus, control 26 is responsive to the absense of control signals from the sensors for the purpose of adjusting the fuel supply to the burners to a level at which the thermo-electric generator of converter 12A and the turbo-generator of converter 11A each produce about half of the power required for load 16A. When one of sensors produces a control signal, control 26A responds by closing the valve of the converter associated with the sensor that produces the control signal cutting the flow of fuel to the burner associated therewith, and effectively shutting down that converter. Simultaneously, control 26A increases the setting of the valve in the other converter to increase the flow of fuel to its burner thus increasing its capacity and enabling it to supply the requirements of the load without the assistance of the other converter which has been shut down.

Figure 2:
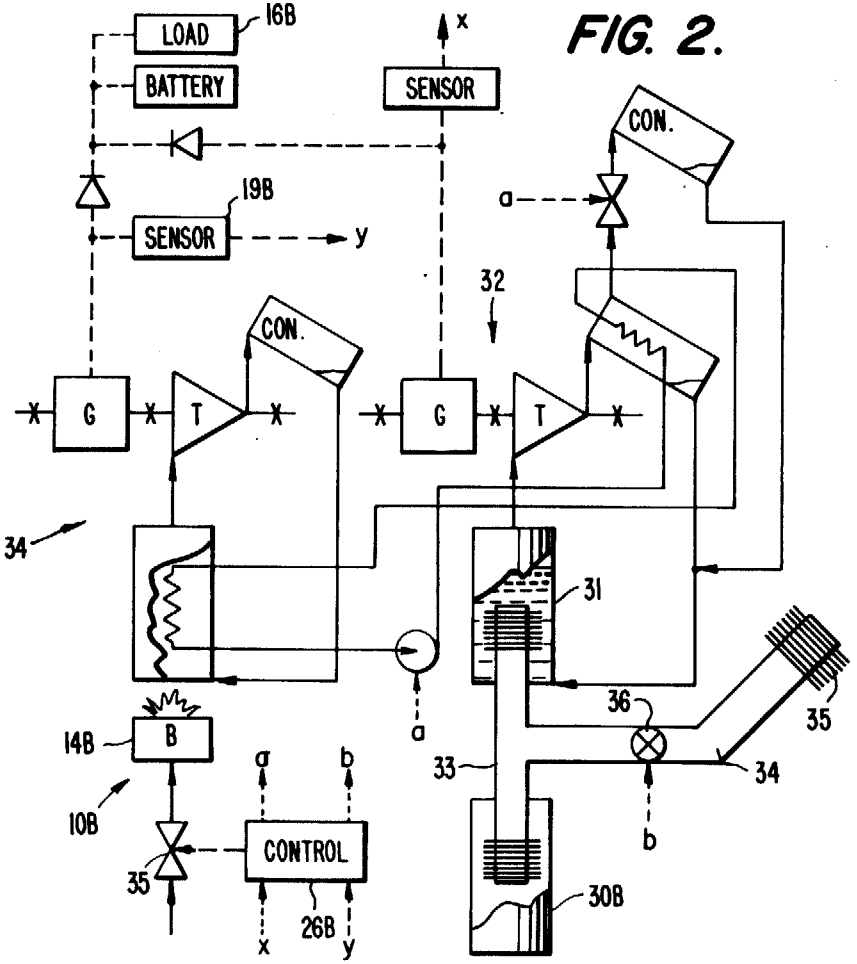
FIG. 2 is a block diagram of another embodiment of a hybrid electric power generating system similar to that shown in U.S. Pat. No. 4,104,535 but wherein the heat for one of the converters is provided by a nuclear reactor.

Referring now to FIG. 2, a second embodiment designated by reference 10B of the present invention is disclosed. This embodiment is similar to the embodiment shown in FIG. 1 of U.S. Pat. No. 4,104,535, except that, in embodiment 10B, the heat for the primary converter is supplied by a radio-isotopic heat source such as nuclear reactor 30B. Heat from this reactor is transferred to vapor generator 31 of primary converter 32 by means of heat pipe 33. Heat pipe 33 includes bypass heat pipe 34 having radiator 35 for transferring heat to an ambient sink such as the atmosphere in order to provide emergency cooling for the reactor. Selectively operable heat flow controller 36 is interposed between nuclear reactor 30B and vapor generator 31 of the primary converter. This controller has a first state in which heat from the reactor is conducted to radiator 35 by way of bypass 34, and a second state in which heat from the reactor is blocked with respect to bypass 34. Control signal "b" applied to the heat flow controller 36 establishes the state thereof. Otherwise, the operation of the device shown in FIG. 2 is the same as the operation shown in the device of FIG. 1 of U.S. Pat. No. 4,104,535.

In general, both converters in embodiment 10B operate at half power supplying load 16B. If reactor 30B malfunctions, the malfunctioning is sensed by control 26B thereby shutting down the reactor, or establishing the state of controller 36, but also opening valve 358 associated with burner 14B of secondary converter 34B enabling the turbo-generator thereof to furnish all of the power to load 16B. Alternatively, a malfunction in converter 34B is sensed by the output of sensor 19B causing controller 26B to interrupt the flow of fuel to burner 14B thereby shutting down converter 34B while at the same time enabling more heat from nuclear reactor 30B to be applied to vapor generator 31. In such case, converter 32 would supply the entire load.

Embodiment 10C is similar to embodiment 10A except that the heat source for thermo-electric generator 40 of converter 41 is a radioisotopic heat source such as nuclear reactor 300 which is similar to nuclear reactor 30 shown in FIG. 2. In operation, thermo-electric generator 40 and turbo-generator 15C of converter 42 each furnish half of the power to load 16C. If a malfunction were to occur in nuclear reactor 30C, such malfunction would be sensed by sensor 25C whose control signal "x" is applied to control 26C. The control responds by shutting down the reactor, and/or establishing the state of controller 36C such that bypass heat pipe 34C would transmit heat to radiator 35C. Simultaneously, valve 27C would be opened by the control allowing burner 14C to receive additional fuel thereby enabling the turbo-generator 15C to supply all of the load requirements. Alternatively, malfunction in converter 42C would be sensed by output of sensor 19C such that the controls of reactor 30C would be modified to enable the reactor to operte at a higher level and thus enable thermo-electric generator 40 to supply all the power to load 16C.

Figure 4:
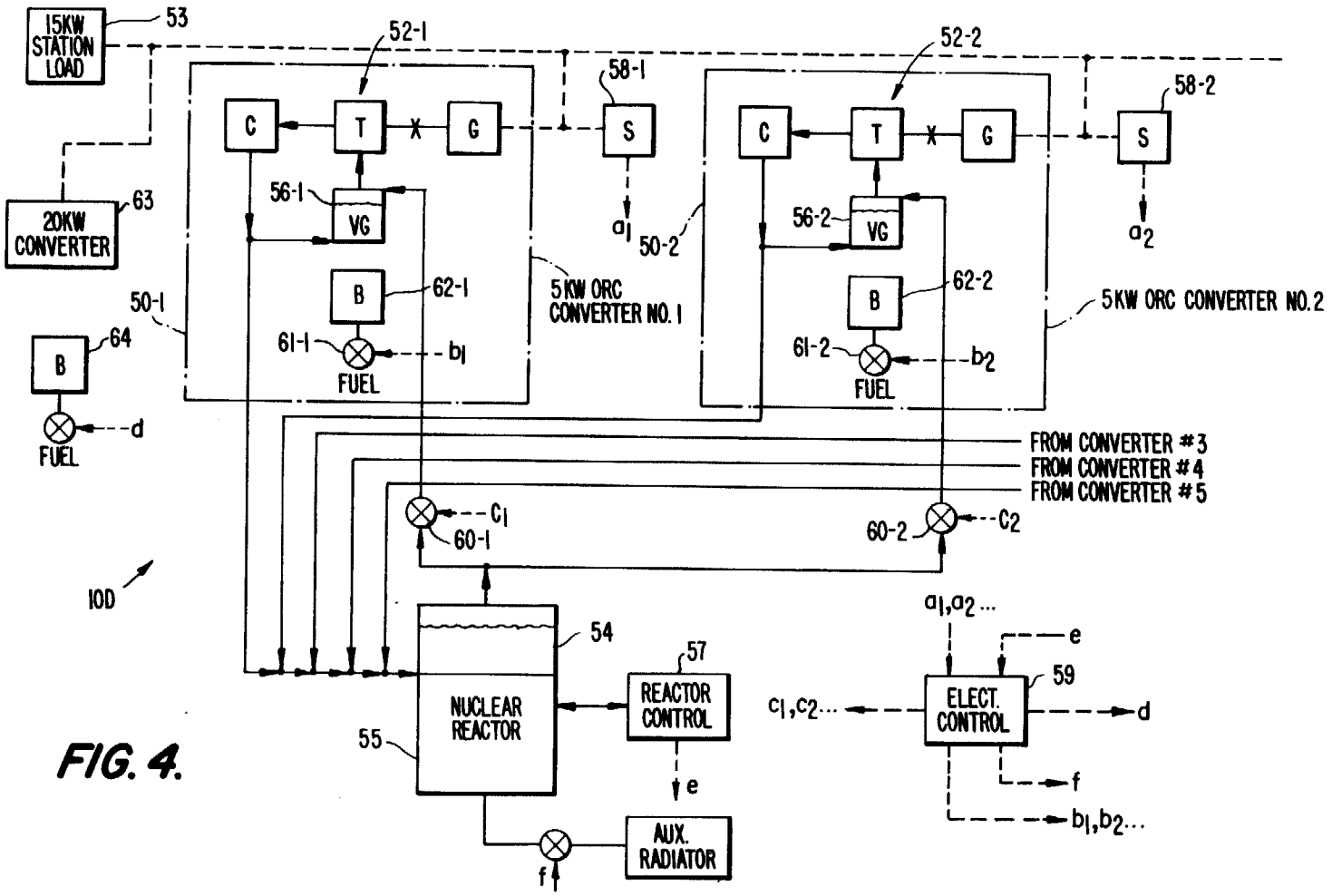
FIG. 4 is a block diagram of still a further embodiment of the present invention showing a plurality of organic fluid Rankine cycle converters in which heat is supplied by either a nuclear reactor or by burners associated with each of the converters in order to establish a highly reliable system.

Embodiment 10D shown in FIG. 4 is a redundant power conversion system comprising a plurality of energy converters each operating on closed Rankine cycle similar to converters 11A and 42 in embodiment 10A and 10C, respectively. That is to say, embodiment 10D has a plurality of substantial identical energy converters designated by reference numerals 50-1, 50-2, etc. Each converter includes a turbo-generator 52-1, 52-2, etc., to which vaporized organic working fluid is supplied enabling the generator of the turbo-generator to supply an equal fraction of the total station load 53. The vaporized working fluid is normally obtained from vapor generator 54 to which heat is supplied by nuclear reactor 55. Vapor exhausted from each turbine of the turbo-generators of the converters is condensed in individual condensers located in the converters or associated with the converters and the condensed working fluid is returned to vaporizer 54. Thus, vapor generator 54 supplies all of the turbines in parallel with vporized working fluid in parallel from vapor generator 54. Preferably, the vapor is applied to the turbines through vapor generators 56-1, 56-2, etc., respectively, associated with the converters.

In the example shown in FIG. 4, five converters are provided, each having a capacity of 5 KW while the station load is less than that, say 15 KW. The controls of the system are establishedsuch that each converter operates just under its rated capacity for furnishing an equal amount of power to the station load. Thus, each converter operates at about 60% of its rated capacity under normal conditions.

When the station load increases, the level of operation of each of the converters is increased by controlling the amount of vapor furnished to the converters in parallel. This is achieved by reactor control 57 which senses the station load.

The output of the turbo-generator associated with each converter is individually sensed by sensors 58-1, 58-2, etc. In the event that one of the turbo-generators, or one of the converters malfunctions, the malfunction is sensed by the sensor which produces a control signal that is applied to electrical control 59. In response, electrical control 59 produces signals that adjust flow control valves 60-1, 60-2, etc., by which vapor is furnished from vapor generator 54 to individual ones of the converters. The converter whose turbo-generator has malfunctioned is deprived of further vapor thus shutting down the operation of that converter while additional vapor is furnished to the remaining operational converters. Thus, the level of operation of the remaining converters increases from about 60% to about 80% which is adequate to supply normal station loads with a reserve for abnormal conditions.

In the event of a malfunction in the nuclear reactor, this condition is sensed by reactor control 57 and conveyed to control 59 for the purpose of operating valves 61-1, 61-2, etc., associated with burners 62-1, 62-2, etc., of the converters. In such case, these burners begin to supply heat to vapor generators 56-1, 56-2, etc., of the converters for enabling them to supply vaporized working fluid to the respective turbo-generators of the converters without interrupting the supply of power to load 53. Again, if a turbo-generator in one of the converters malfunctions, control 59 is effected to shut down the fuel supply of that converter and increase the fuel supply to the other converters enabling them to take up the entire load for the station.

Finally, a backup converter 63 may also be provided of a capacity equal to the rated capacity of each of individual converters 50-1, 50-2, etc. Heat to converter 63 is furnished by burner 64 under the control of electrical control 59. Converter 63 is provided to permit maintenance of the main converters 50-1, 50-2, etc.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

I claim:

1. A hybrid power system comprising:

(a) a first energy converter operating on a closed Rankine cycle and including a vapor generator for vaporizing an organic working fluid in response to heat furnished from a heat source associated with the vapor generator, a turbo-generator responsive to vaporized working fluid for generating electrical power, a condenser responsive to vapor exhausted from the turbo-generator for converting such vapor to a condensed liquid, and means for returning said liquid to the vapor generator;

(b) a second energy converter including a thermo-electric generator having a junction, a heat source for heating said junction whereby such thermo-electric generator generates electrical power;

(c) a heat pipe for conveying heat from the heat source of said second converter to the vapor generator of said first converter and to said junction; and (d) means for applying the electrical power generated by said first and second converters to an electrical load.

2. A hybrid power system according to claim 1 including a sensor individually associated with each converter for generating a control signal when electrical power generated by the converter associated with the sensor decreases below a threshold, and control means responsive to control signals generated by the sensors for controlling the operation of the heat sources of the converters.

3. A hybrid power system according to claim 2 wherein the heat source of the first converter is a burner that burns fossil fuel.

4. A hybrid power system according to claim 3 wherein said control means is responsive to a control signal generated by the sensor of the first converter for cutting off the flow of fuel to the burner thereof.

5. The hybrid power system according to claim 4 wherein said control means is responsive to a control signal generated by the sensor of the first converter for increasing the heat produced by the heat source in the second converter.

6. A hybrid power system according to claim 2 wherein the heat source of each converter is a burner that burns fossil fuel, and said control means is responsive to a control signal generated by a sensor from one of the converters for cutting off the flow of fuel to the burner of said one converter, and to increase the flow of fuel to the burner of the other converter.

7. A hybrid power system according to claim 5 wherein the heat source of the second converter is a radioisotopic heat source.

8. A hybrid power system according to claim 7 wherein said heat pipe includes a bypass heat pipe having radiator means for transferring heat to an ambient sink; and a selectively operable heat-flow controller interposed between said radioisotopic source and the vapor generator of said first converter, said controller having a first state in which heat from said radioisotopic source is conducted to said radiator means of said bypass, and a second state in which heat from said radioisotopic source is blocked with respect to said bypass.

9. A hybrid power system according to claim 8 including a reactor level sensor for sensing the reactor level in said radioisotopic heat source and producing a control signal when said level increases or decreases with respect to a threshold, said heat flow controller been responsive to a control signal from said reactor level sensor for causing the state of said control to change and to remain in a new state.

10. A hybrid power system comprising:

(a) at least two energy converters, each operating in a closed Rankine cycle and each including a vapor generator for vaporizing an organic working fuid in response to heat furnished from a heat source associated with the vapor generator, a turbo-generator responsive to vaporized working fluid for generating electrical power, a condenser responsive to vapor exhausted from the turbo-generator for converting such vapor to a condensed liquid, and means for returning said liquid to the vapor generator;

(b) the heat source for one of the converters including a nuclear reactor, and the heat source of the other of the converters been a burner that burns fossil fuel;

(c) a sensor individually associated with each converter for generating a control signal when electrical power generated by the converter associated with the sensor decreases below a threshold; and (d) control means responsive to control signals generated by the sensors for controlling the operation of the heat source of the converters.

11. A hybrid power system according to claim 10 including means for rejecting heat from the condenser of said one converter into the vapor generator of said other converter only in the absence of the control signal from the sensor associated with said other converter.

12. A hybrid power system according to claim 11 wherein said means for rejecting heat is associated with the condenser of said one converter.

13. A hybrid power system according to claim 12 including a heat pipe for transferring heat between said radioactive heat source and the vapor generator of said one converter, a bypass heat pipe having radiator means for transferring heat to an ambient sink, and a selectively operable heat-flow controller interposed between said reactor and the vapor generator of the first converter, said controller having a first state in which heat from said reactor is conducted to said radiator means of said bypass, and second state in which heat from said reactor is blocked with respect to said bypass.

14. A hybrid power system according to claim 13 including a reactor level sensor for sensing the reactor level in said reactor and producing a control signal when said level increases both threshold, and said heat-flow controller being responsive to a control signal said reactor level sensor for causing the state of said controller to change to and remain in said first state.

15. A redundant power conversion system comprising:

(a) a plurality of energy converters each of which operates on a closed Rankine cycle and each of which includes a vapor generator for vaporizing an organic working fluid in response to heat furnished from a heat source associated with a vopor generator, a turbo-generator responsive to vaporized working fluid for generating electrical power, and a condenser responsive to vapor exhausted from the turbo-generator for converting such vapor to a condensed liquid, and means for returning said liquid to the vapor generator, and a sensor for generating a control signal when the electrical power generated by the converter decreases below a threshold;

(b) each converter having a heat source in a form of a burner, and a selectively operable fuel control valve for applying fuel to the burner which furnishes heat to the vapor generator;

(c) an operable nuclear reactor;

(d) a vapor generator associated with the nuclear reactor for vaporizing an organic working fluid when said nuclear reactor is operating;

(e) means for selectively furnishing vaporized working fluid from the vapor generator associated with the nuclear reactor to each turbo-generator of said energy converter; and (f) control means responsive to control signals generated by said sensors for controlling the operation of said nuclear reactor and the burners of said converters.

16. A redundant power conversion system according to claim 15 including a nuclear reactor malfunction sensor for producing a malfunction control signal in response to a malfunction of the nuclear reactor, said control means been responsive to the absence of a malfunction control signal for effecting the transfer of vaporized working fluid from the vapor generator associated with the nuclear reactor and preventing operation of the burner of each converter, and being responsive to the presence of a malfunction control signal for causing said burners to operate and furnish heat to the vapor generator of the respective converters.

17. A redundant power conversion system according to claim 16 wherein the total rated capacity of the converters exceeds the normal load on the system.

* * * * *

UNITED STATES PATENT AND TRADEMARK OFFICE

CERTIFICATE OF CORRECTION

PATENT NO. : 4,622,472

DATED : November 11, 1986

INVENTOR(S) : Lucien Y. Bronicki

It is certified that error appears in the above-identified patent and that said Letters Patent is hereby corrected as shown below:

At column 5, line 41 of the printed patent, "vporized" should be changed to ---vaporized---;
At column 5, line 49 of the printed patent, "establishedsuch" should be changed to ---established such---;
At column 7, line 43 of the printed patent, "fuid" should be changed to ---vapor---.
At column 4, lines 59 of the printed patent, "valve 358" should be changed to ---valve 35---;
At column 5, line 4 of the printed patent, "reactor 300" should be changed to ---reactor 30---; and
At column 5, line 17 of the printed patent, "converter 42c" should be changed to ---converter 42---.

Signed and Sealed this

Fifth Day of July, 1988

*Attest:*

DONALD J. QUIGG

*Attesting Officer*

*Commissioner of Patents and Trademarks*